US010090602B2

(12) United States Patent
Manasson et al.

(10) Patent No.: US 10,090,602 B2
(45) Date of Patent: Oct. 2, 2018

(54) WAVEGUIDE FEED FOR STEERABLE BEAM ANTENNA

(71) Applicant: SIERRA NEVADA CORPORATION, Sparks, NV (US)

(72) Inventors: Vladimir A. Manasson, Irvine, CA (US); Lev S. Sadovnik, Irvine, CA (US)

(73) Assignee: Sierra Nevada Corporation, Sparks, NV (US)

( * ) Notice: Subject to any disclaimer, the term of this patent is extended or adjusted under 35 U.S.C. 154(b) by 163 days.

(21) Appl. No.: 15/387,413

(22) Filed: Dec. 21, 2016

(65) Prior Publication Data

US 2018/0175508 A1 Jun. 21, 2018

(51) Int. Cl.

| | |
|---|---|
| ***H01Q 13/28*** | (2006.01) |
| ***H01Q 9/42*** | (2006.01) |
| ***H01Q 9/26*** | (2006.01) |
| ***H01Q 3/26*** | (2006.01) |

(52) U.S. Cl.
CPC ..... *H01Q 13/28* (2013.01); *H01Q 3/26* (2013.01); *H01Q 9/42* (2013.01)

(58) Field of Classification Search
CPC ..... H01Q 13/28; H01Q 3/26; H01Q 9/42
USPC ..... 343/785
See application file for complete search history.

(56) References Cited

U.S. PATENT DOCUMENTS 4,463,330 A * 7/1984 Yoneyama ..... H01P 3/165 333/239
5,473,296 A * 12/1995 Ishikawa ..... H01P 3/165 333/239
5,572,228 A 11/1996 Manasson et al.
5,815,124 A 9/1998 Manasson et al.
5,933,120 A 8/1999 Manasson et al.
5,959,589 A 9/1999 Sadovnik et al.
6,211,836 B1 4/2001 Manasson et al.
(Continued)

OTHER PUBLICATIONS

International Search Report on corresponding PCT application (PCT/US2017/01062819) from International Searching Authority (KIPO) dated May 17, 2018.
(Continued)

*Primary Examiner* — Dameon E Levi
*Assistant Examiner* — Jennifer F Hu
(74) *Attorney, Agent, or Firm* — Klein, O'Neill & Singh, LLP

(57) ABSTRACT

A steerable beam antenna includes a rotatable drum having a diffraction grating surface, and a waveguide feed including first and second conductive metal bases extending axially along the length of the drum, each of the bases having an inner surface spaced from and opposed to the inner surface of the other base, and a proximal surface spaced from the drum surface by a gap. First and second parallel conductive metal plates extend distally from the first and second bases, respectively, the first and second plates having respective inner surfaces separated by an inter-plate space. First and second dielectric strips are flush-mounted on the inner surfaces of the first and second conductive metal bases, respectively, the first dielectric strip extending longitudinally along the inner surface of the first base, and the second dielectric strip extending longitudinally along the inner surface of the second base, opposite the first dielectric strip.

24 Claims, 4 Drawing Sheets

(56) References Cited

U.S. PATENT DOCUMENTS

| | | | |
|---|---|---|---|
| 6,750,827 | B2 | 6/2004 | Manasson et al. |
| 7,151,499 | B2 | 12/2006 | Avakian et al. |
| 7,667,660 | B2 | 2/2010 | Manasson et al. |
| 2009/0243950 | A1 | 10/2009 | Manasson et al. |
| 2012/0056794 | A1 | 3/2012 | Manasson et al. |

OTHER PUBLICATIONS

Written Opinion on corresponding PCT application (PCT/US2017/01062819) from International Searching Authority (KIPO) dated May 17, 2018.

* cited by examiner

WAVEGUIDE FEED FOR STEERABLE BEAM ANTENNA

CROSS-REFERENCE TO RELATED APPLICATION

Not Applicable

FEDERALLY SPONSORED RESEARCH OR DEVELOPMENT

Not Applicable

BACKGROUND

Steerable beam antennas that allow for the transmission and/or reception of a highly directional electromagnetic signals are well-known in the art, as exemplified by U.S. Pat. No. 6,750,827; U.S. Pat. No. 6,211,836; U.S. Pat. No. 5,815,124; and U.S. Pat. No. 5,959,589. These exemplary prior art antennas include a waveguide feed that provides the evanescent coupling of electromagnetic waves between a waveguide feed including an elongate (typically rod-like) dielectric element, and a cylinder or drum spinning or rotating on an axis parallel to the axis of the dielectric element, and then radiating the coupled electromagnetic energy in directions determined by a diffraction grating provided by surface features (such as, for example, grooves) of the drum. By defining rows of features, wherein the features of each row have a different period, and by rotating the drum around an axis that is parallel to that of the dielectric element, the radiation can be directed in a plane over an angular range determined by the different periods.

As noted above, the typical waveguide feed used with a spinning drum antenna includes an elongate dielectric rod, typically of quartz. Such rods are inherently fragile, and their placement usually requires some manual labor to obtain the needed precision. Furthermore, the spinning drum with a groove pattern creates air flows for which the dielectric rod presents a bluff body that creates air vortices, thereby causing rod vibrations, and otherwise degrading dynamic antenna parameters.

Accordingly, it would be advantageous to provide a steerable beam antenna in which the problems associated with a rod-like dielectric coupling element are minimized or substantially reduced.

SUMMARY

Broadly, a steerable beam antenna in accordance with this disclosure comprises a cylindrical drum rotatable around a longitudinal axis and having a surface providing a diffraction grating, a bifurcated waveguide feed comprising first and second parallel waveguide feed portions extending longitudinally (axially) along the length of the drum, and an opposed pair of dielectric coupling elements, each of which is configured as flush-mounted dielectric strip extending longitudinally along an inner surface of each of the waveguide feed portions.

In one aspect, the steerable beam antenna comprises a rotatable drum having a drum surface configured as a diffraction grating; a bifurcated waveguide feed comprising first and second conductive metal bases plates extending longitudinally (axially) along the length of the drum, each of the bases having an inner surface opposed to and spaced from the corresponding inner surface of the other base, and a proximal surface spaced from the drum surface by an air gap. First and second conductive metal plates extend distally from the first and second bases, respectively. The first and second plates are parallel to each other and define respective inner surfaces separated by an inter-plate space. The first and second plates are thereby advantageously configured as an output horn. First and second flush-mounted dielectric strips on the inner surface of each of the first and second metal bases, respectively. Each dielectric strip extends longitudinally (axially) along the inner surface of its respective base. In specific embodiments, the proximal surface of each of the first and second bases may have one or more longitudinally-extending "choke" grooves.

Performance optimization may be achieved, in some embodiments, with a dielectric strip width (distance between its proximal edge and its distal edge) of approximately one-half wavelength ($\lambda/2$) of the transmitted beam. Preferably, the thickness of each of the dielectric strips is substantially less than the wavelength $\lambda$. An inter-plate space of approximately one-half wavelength ($\lambda/2$) is considered optimum, although not critical. The width of the air gap between the proximal edges of the plates and the drum surface should preferably not exceed $\lambda/4$, to optimize evanescent coupling between the diffraction grating of the drum surface and the dielectric waveguide provided by the dielectric strips. In embodiments having one or more choke grooves in each of the plates, the optimum width and depth of each groove are both preferably approximately $\lambda/4$.

As will be appreciated from the detailed description below, steerable beam antennas in accordance with this disclosure provide efficient evanescent coupling between the rotating or spinning diffraction grating on the drum surface and the dielectric strips, without the aforementioned disadvantages of quartz rod dielectric coupling elements. For example, the dielectric strips are easily fabricated and attached to the plates that form the antenna output elements, thereby simplifying the fabrication process. Furthermore, configured as thin flat strips flush-mounted on the inner surfaces of the plates, the dielectric elements do not exhibit the aerodynamic problems and vibrational tendencies to which the rod-like elements are prone, as noted above. These and other advantages will be apparent from the detailed description that follows.

DETAILED DESCRIPTION

Figure 1:
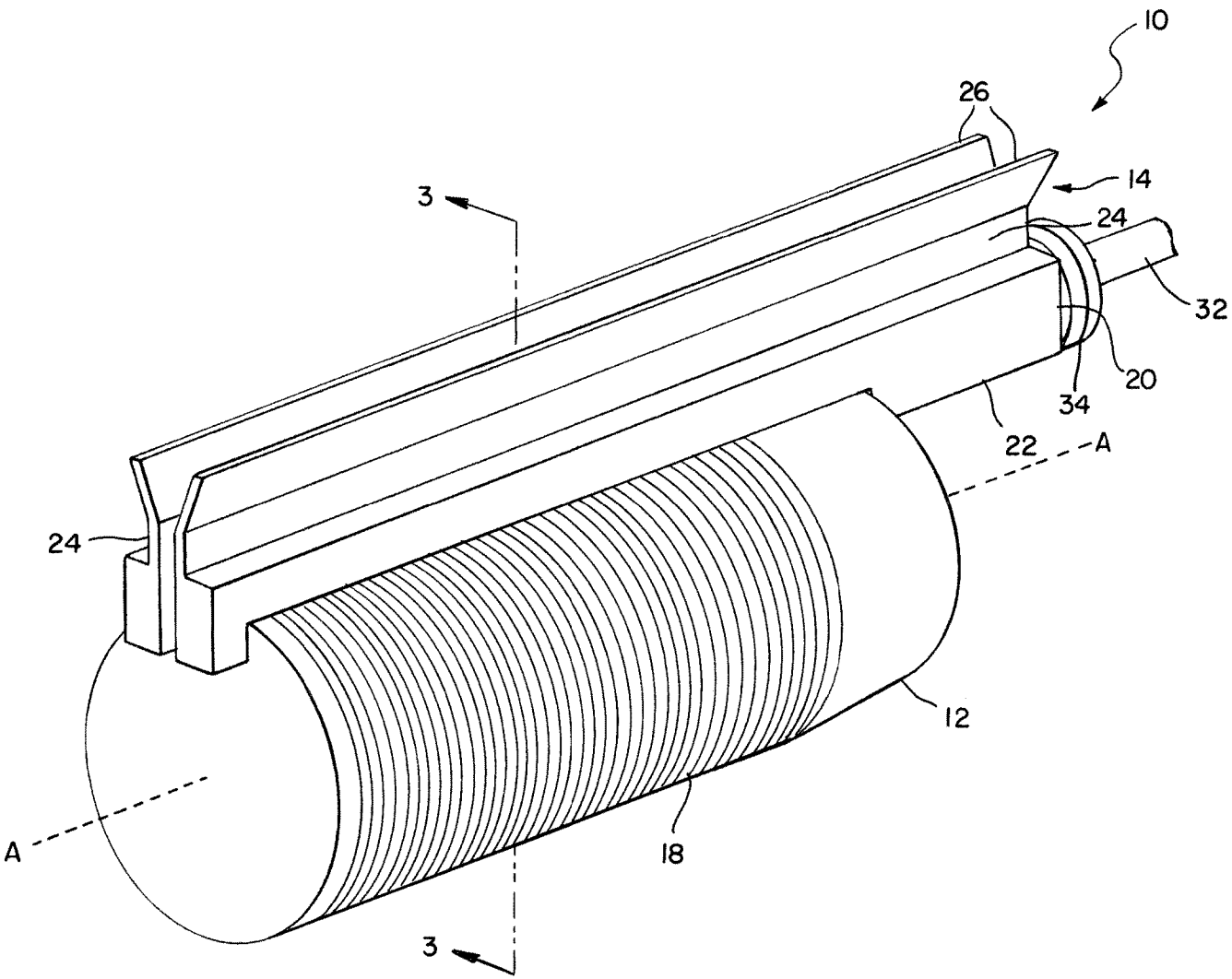
FIG. 1 is a simplified perspective view of a steerable beam antenna in accordance with aspects of this disclosure.

Referring to the drawings, a steerable beam antenna 10 in accordance with aspects of this disclosure is shown. The antenna 10 comprises a cylindrical drum 12 that is rotatable around a longitudinal axis A, a bifurcated, conductive metal waveguide feed comprising first and second parallel waveguide feed portions 14 extending axially (longitudinally) along the length of the drum 12, and flush-mounted dielectric strips 16 extending longitudinally along an inner surface of each of the waveguide feed portions 14.

The drum 12, which may be of a conventional type for a steerable beam antenna, is provided with a diffraction grating 18 on a major portion of its outer surface. The diffraction grating 18 may have any suitable configuration well known in the art, such as, for example, a pattern of annular grooves that define desired periodicities suitable for the range of wavelengths to be transmitted and/or received. Thus, although the grating grooves are illustrated (for the sake of simplicity) with a substantially uniform periodicity, in actuality the periodicity of the grooves will typically be varied at different angular positions along the length of the drum 12, whereby the groove pattern forms a diffraction grating 18 designed to provide the desired beam shape.

Figure 3:
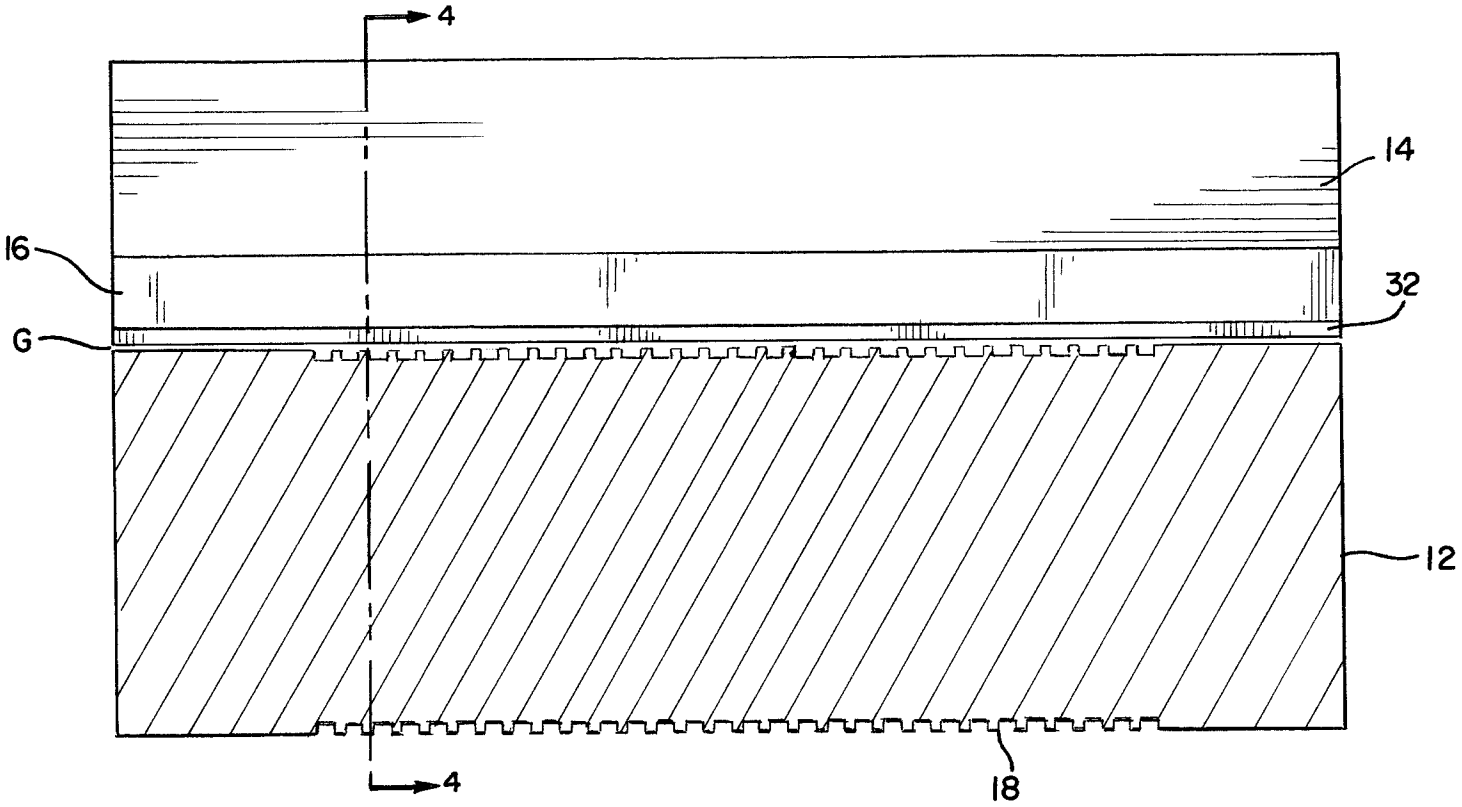
FIG. 3 is a cross-sectional view taken along line 3-3 of FIG. 1.
Figure 4:
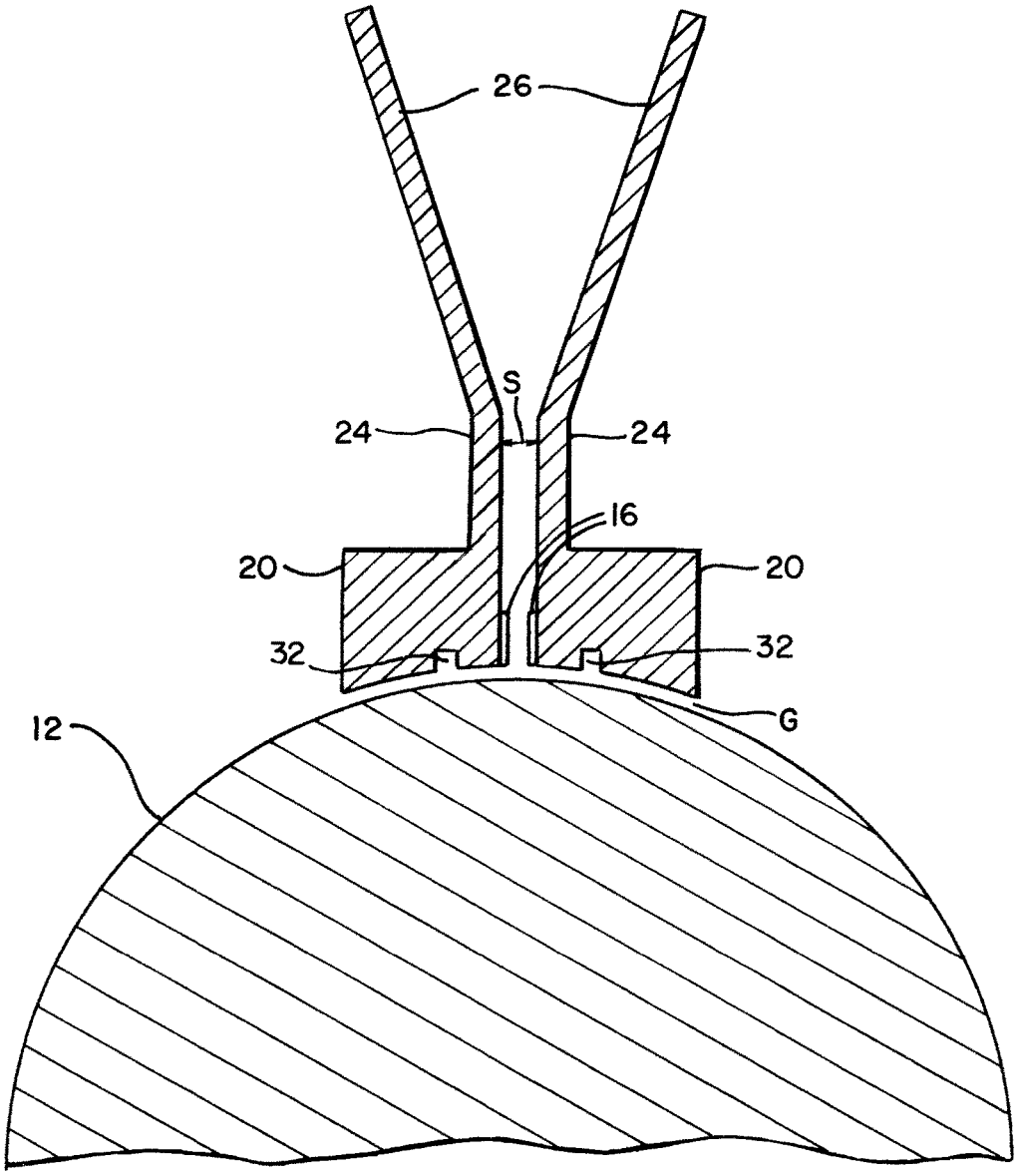
FIG. 4 is a cross-sectional view taken along line 4-4 of FIG. 3.

The first and second waveguide feed portions 14 include first and second conductive metal bases 20, respectively. Each of the first and second bases extends longitudinally (axially) along the length of the drum 12. Each of the first and second bases 20 has a proximal (with respect to the drum) surface that is spaced from the outer surface of the drum 12 by an air gap G (see FIGS. 3 and 4). A transition portion 22 is provided at each end of each of the first and second bases 20, wherein the transition portions 22 at opposite first and second ends of each base 20 are axially spaced from the respective ends of the drum 12. (The structure and function of the transition portions 22 will be discussed below.) Each waveguide feed portion 14 includes a conductive metal plate 24 that extends distally (with respect to the drum 12) from the base 20 of that waveguide feed portion. The plates 24 are advantageously parallel to each other, separated by an inter-plate space S (see FIG. 4), which may be approximately equal to the distance separating the first and second bases 20 in many embodiments. As would be appreciated by those skilled in the pertinent arts, the dielectric strips 16 function as waveguide cores that provide efficient evanescent radiation coupling between the waveguide feed portions 14 and the diffraction grating 18, with minimal radiation leakage through the air gap G and the inter-plate space S.

The distal portions of the plates 24 form an output horn 26 that forms a beam shape in a plane orthogonal to the drum axis A. In some embodiments, such as shown in the drawings, the output horn 26 has an outwardly-flared configuration. Other configurations for the output horn are known, and will readily suggest themselves to those skilled in the art.

The waveguide feed portions 14 are secured to each other at the transition portions 22, one at each of the opposite first and second ends of each of the first and second bases 20, as described above. The transition portions 22 of one waveguide feed portion 14 may be secured to the transition portions 22 of the other waveguide feed portion 14 by any suitable attachment or fastening means (not shown), such as, for example, screws, bolts, welding joints, rivets, etc. The transition portions 22 at opposite ends of each of the bases 20 are spaced from the ends of the drum 12 so as to provide a clearance that accommodates the rotation of the drum 12. The structure and configuration of the waveguide feed portions 14, including their respective transition portions 22, as well as the space S between the plates 24, are such that the plates 24 have a mirror symmetry with respect to an imaginary plane located between the plates 24 and parallel to them.

Figure 2:
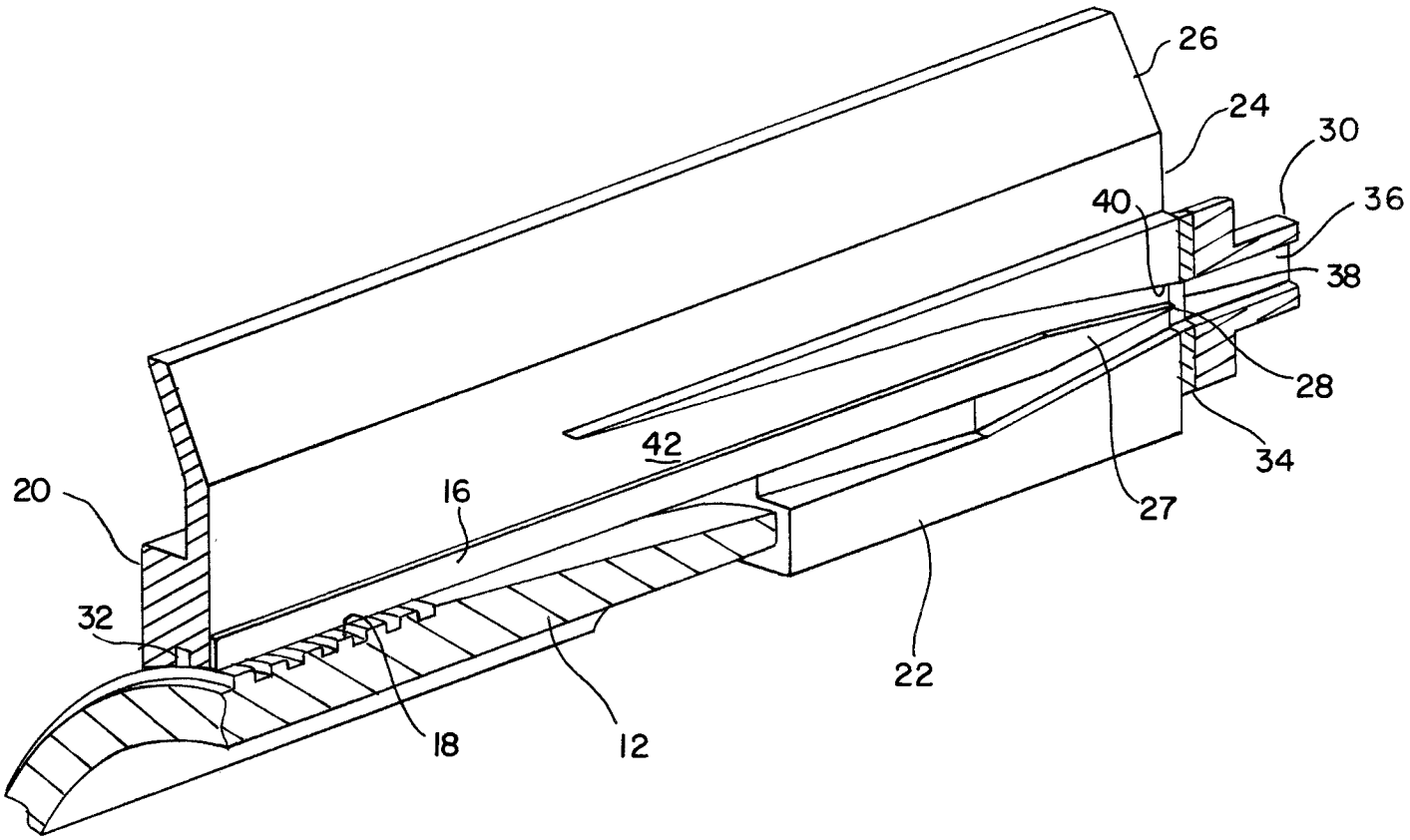
FIG. 2 is a perspective view, partly in cross-section, of the feeding end of the antenna shown in FIG. 1, showing details of the structure.

Each of the waveguide feed bases 20 has an inner surface spaced from and parallel to the inner surface of the other waveguide enclosure base 20. First and second dielectric strips 16 extend longitudinally (axially) along the inner surface of the first and second waveguide feed bases 20, respectively, adjacent the proximal surface thereof. As mentioned above, the dielectric strips 16 are flush-mounted on their respective bases, and they may be secured to their respective bases 20 by, for example, a suitable adhesive. As best shown in FIG. 2, at least one end (and, in some embodiments, both ends) of each of the dielectric strips 16 may have a tapered configuration 27 so as to terminate in a pointed tip 28, for improved impedance-matching with an external waveguide 30 (FIGS. 1 and 2) that may typically be attached to one or both ends of the antenna 10 in an antenna system, as discussed in more detail below. A preferred material for the dielectric strips 16 is a glass microfiber-reinforced PTFE composite laminate, of the type, for example, marketed by Rogers Corporation, of Chandler, Ariz., under the trademark RT/duroid® 5880. Equivalent materials will readily suggest themselves to those skilled in the art.

In an antenna operable to transmit and/or receive an electromagnetic signal of a defined wavelength $\lambda$, an inter-plate space S having a width of approximately one-half wavelength ($\lambda/2$) of the transmitted/received signal is considered optimum, although not critical. The width of the air gap G between each of the waveguide feed bases 20 and the surface of the drum 12 should preferably not exceed $\lambda/4$, to optimize evanescent coupling between the diffraction grating 18 of the drum surface and the dielectric strips 16, while allowing clearance for the rotation of the drum 12. Performance optimization may be achieved, in some embodiments, with a dielectric strip width (distance between the proximal edge and distal edge of each dielectric strip 16) of approximately one-quarter wavelength ($\lambda/4$) to one-half wavelength ($\lambda/2$) of the transmitted/received beam. Preferably, the thickness of each of the dielectric strips 16 is substantially less than the wavelength $\lambda$. For use of the antenna 10 to transmit/receive radiation in the millimeter wavelength band, an exemplary thickness of about 0.5 mm is suggested, although this specific thickness is not critical.

In specific embodiments, the proximal surface of each of the first and second bases 20 will advantageously have one or more longitudinally-extending "choke" grooves 32, essentially parallel with the dielectric strip 16 attached to each base 20. As is known in the art, the choke grooves 32 reduce leakage of scattered signal through the air gap G between the waveguide feed bases 20 and the drum 12, thereby increasing signal propagation through the output horn 26. The optimum width and depth of the choke grooves 32 are both preferably approximately $\lambda/4$.

As mentioned above, antennas of the type described herein are typically used in steerable beam antenna systems for the transmission/reception of electromagnetic radiation in millimeter wavelengths, such as the W waveband (75-110 GHz). Such systems typically use an external waveguide 30 at one or both ends of the antenna 10. To match the impedance $Z_F$ of the external waveguide(s) 30 with the impedance $Z_A$ of the antenna 10, an impedance-matching transformer 34 is typically installed between each external waveguide 30 and the transition portions 22 at each end of the antenna 10 that is coupled to an external waveguide 30. The transition portions 22 are specifically designed, in accordance with an aspect of this disclosure, to provide, in conjunction with the impedance-matching transformer(s) 34 and the tapered end portions 27 of the dielectric strips 16, a gradual transition of the impedance from $Z_F$ (the first impedance) to $Z_A$ (the second impedance), thereby avoiding the creation of parasitic modes of the radiation coupled to or from the antenna 10 through the external waveguide(s) 30.

One specific exemplary embodiment of a transition portion 22 in accordance with an aspect of this disclosure is illustrated in FIG. 2. As shown, the external waveguide 30 includes a central axial waveguide slot 36 that is aligned with a central axial transformer slot 38 in the impedance-matching transformer 34. The transformer slot 38, in turn, is aligned with a narrow end-opening 40 of a longitudinal internal recess 42 in the transition portion 22. The tapered end portion 27 of the dielectric strip 16 is located in the recess 42 so that the pointed tip 28 of the dielectric strip 16 is located on the opposite side of the end-opening 40 from the transformer slot 38. The recess 42, in turn, has a configuration that, in combination with the tapered end portion 27 of the dielectric strip 16, effects the gradual impedance transition without the creation of parasitic modes, as mentioned above. Specifically, a first vertical (height) taper of the recess 42 increases the vertical height of the recess 42 from a minimum height at the end-opening 40 to a maximum height a short distance axially from the tapered end portion 27 of the dielectric strip 16. From the point of maximum height to the inner end of the transition portion 22, the recess 42 gradually narrows slightly. Similarly, the depth of the recess 42 decreases slightly from the end-opening 40 to approximately the point of maximum height, and then increases slightly from that point to the inner end of the transition portion 22.

It will be appreciated that, in some embodiments, the structure shown in FIG. 2 is representative of the structure of both ends of both dielectric strips 16, and the corresponding structure in each of the four transition portions 22. Thus, for example, in some embodiments, particularly those in which an external waveguide 30 is coupled, via an impedance-matching transformer 34, to each end of the antenna 10, each of the dielectric strips 16 includes the tapered configuration 27, 28 shown in FIG. 2 at both ends, while each of the four transition portions 22 includes a longitudinal recess 42, configured as shown in FIG. 2, in which the tapered end portion 27 of the associated dielectric strip 16 is located.

The above-described description of the transition portions 22, as illustrated in the drawings, is exemplary only. In practice, the specific geometry and construction of the transition portions 22 and the dielectric strips 16 may be dictated by such factors as the operational frequency of the antenna, the bandwidth of the antenna beam, the materials used, and the specific antenna geometry. The object in all cases is to minimize reflection of waves at the external waveguide/antenna interface and to provide single mode operation (i.e., minimizing parasitic modes).

While exemplary embodiments have been described above and illustrated in the drawings, it will be appreciated that variations and modifications of these embodiments may suggest themselves to those skilled in the pertinent arts. Thus, as noted above, such aspects as the configuration of the waveguide feed (including, for instance, the output horn), the structure and configuration of the transition portions (including their internal structure and configuration), and the configuration of the dielectric strips may be varied or modified without departing from the spirit and scope of the disclosure. Any dimensions set forth above are, likewise, exemplary only and not limiting. Such variations and modifications, and any equivalents thereof, are to be considered within the scope of this disclosure.

What is claimed is:

1. A steerable beam antenna, comprising:

a rotatable drum having a drum surface configured as a diffraction grating;

a waveguide feed comprising:

first and second conductive metal bases extending axially along the length of the drum, each of the bases having an inner surface spaced from and opposed to the inner surface of the other base, and a proximal surface spaced from the drum surface by a gap; and first and second conductive metal plates extending distally from the first and second conductive metal bases, respectively, the first and second plates being parallel to each other and having respective inner surfaces separated by an inter-plate space; and first and second dielectric strips flush-mounted on the inner surfaces of the first and second conductive metal bases, respectively, the first dielectric strip extending longitudinally along the inner surface of the first base, and the second dielectric strip extending longitudinally along the inner surface of the second base, opposite the first dielectric strip.

2. The steerable beam antenna of claim 1, wherein the proximal surface of each of the conductive metal bases has at least one longitudinally-extending choke groove.

3. The steerable beam antenna of claim 2, wherein the antenna is operable to transmit and/or receive an electromagnetic beam of a defined wavelength, and wherein each of the choke grooves has a width and a depth that are both approximately one-quarter the defined wavelength.

4. The steerable beam antenna of claim 1, wherein the antenna is operable to transmit and/or receive an electromagnetic beam of a defined wavelength, and wherein each of the dielectric strips has a width of approximately one-half the defined wavelength.

5. The steerable beam antenna of claim 1, wherein the antenna is operable to transmit and/or receive an electromagnetic beam of a defined wavelength, and wherein each of the dielectric strips has a thickness substantially less than the defined wavelength.

6. The steerable beam antenna of claim 1, wherein the antenna is operable to transmit and/or receive an electromagnetic beam of a defined wavelength, and wherein the inter-plate space is approximately one-half the defined wavelength.

7. The steerable beam antenna of claim 1, wherein the antenna is operable to transmit and/or receive an electromagnetic beam of a defined wavelength, and wherein the gap between the proximal surface of the conductive metal bases and the drum surface does not exceed one-quarter the defined wavelength.

8. The steerable beam antenna of claim 1, wherein each of the first and second bases has first and second ends, and wherein the waveguide feed includes a transition portion at the first and second ends of each of the first and second bases.

9. The steerable beam antenna of claim 8, wherein the first and second conductive metal bases are connected to each other at the transition portions.

10. The steerable beam antenna of claim 8, wherein the transition portions at the first ends of the first and second bases include a longitudinal recess, and wherein each of the dielectric strips has a tapered end portion located in the recess.

11. The steerable beam antenna of claim 8, wherein each of the transition portions at the first ends of the first and second bases includes a first longitudinal recess, wherein each of the transition portions at the second ends of the first and second bases includes a second longitudinal recess, and wherein each of the dielectric strips has a first tapered end portion located in one of the first recesses and a second tapered end portion located in one of the second recesses.

12. The steerable beam antenna of claim 11, wherein each of the tapered end portions terminates in a pointed tip.

13. A steerable beam antenna system, comprising:

an antenna having a first impedance, the antenna comprising a drum rotatable around an axis and having a drum surface configured as a diffraction grating, and a waveguide feed, wherein the waveguide feed comprises:

first and second conductive metal bases extending axially along the length of the drum, each of the bases having an inner surface spaced from and opposed to the inner surface of the other base, and a proximal surface spaced from the drum surface by a gap; and first and second conductive metal plates extending distally from the first and second conductive metal bases, respectively, the first and second plates being parallel to each other and having respective inner surfaces separated by an inter-plate space;

wherein each of the first and second bases has first and second ends, and wherein the waveguide feed includes a transition portion at the first and second ends of each of the first and second bases, each of the transition portions including an internal longitudinal recess configured to receive an end portion of one of the dielectric strips;

first and second dielectric strips flush-mounted on the inner surfaces of the first and second conductive metal bases, respectively, the first dielectric strip extending longitudinally along the inner surface of the first base, and the second dielectric strip extending longitudinally along the inner surface of the second base, opposite the first dielectric strip; and an external waveguide having a second impedance coupled to the transition portions of at least one of the first and second ends of each of the first and second bases, wherein the transition portions to which the external waveguide is coupled and the end portions of the dielectric strips are configured to effect a gradual transition from the second impedance to the first impedance without creating parasitic modes of radiation coupled to or from the antenna through the external waveguide.

14. The steerable beam antenna system of claim 13, wherein the proximal surface of each of the conductive metal bases has at least one longitudinally-extending choke groove.

15. The steerable beam antenna system of claim 14, wherein the antenna is operable to transmit and/or receive an electromagnetic beam of a defined wavelength, and wherein each of the choke grooves has a width and a depth that are both approximately one-quarter the defined wavelength.

16. The steerable beam antenna system of claim 13, wherein the antenna is operable to transmit and/or receive an electromagnetic beam of a defined wavelength, and wherein each of the dielectric strips has a width of approximately one-half the defined wavelength.

17. The steerable beam antenna system of claim 13, wherein the antenna is operable to transmit and/or receive an electromagnetic beam of a defined wavelength, and wherein each of the dielectric strips has a thickness substantially less than the defined wavelength.

18. The steerable beam antenna system of claim 13, wherein the antenna is operable to transmit and/or receive an electromagnetic beam of a defined wavelength, and wherein the inter-plate space is approximately one-half the defined wavelength.

19. The steerable beam antenna system of claim 13, wherein the antenna is operable to transmit and/or receive an electromagnetic beam of a defined wavelength, and wherein the gap between the proximal surface of the conductive metal bases and the drum surface does not exceed one-quarter the defined wavelength.

20. The steerable beam antenna system of claim 13, wherein the external waveguide is coupled to the antenna through an impedance-matching transformer.

21. The steerable beam antenna system of claim 13, wherein the first and second conductive metal bases are connected to each other at the transition portions.

22. The steerable beam antenna system of claim 13, wherein the transition portions at the first ends of the first and second bases include a longitudinal recess, and wherein each of the dielectric strips has a tapered end portion located in the recess.

23. The steerable beam antenna system of claim 13, wherein each of the transition portions at the first ends of the first and second bases includes a first longitudinal recess, wherein each of the transition portions at the second ends of the first and second bases includes a second longitudinal recess, and wherein each of the dielectric strips has a first tapered end portion located in one of the first recesses and a second tapered end portion located in one of the second recesses.

24. The steerable beam antenna system of claim 23, wherein each of the tapered end portions terminates in a pointed tip.

* * * * *